United States Patent [19]

Friday

[11] 4,080,053

[45] Mar. 21, 1978

[54] TRANSFER APPARATUS AND METHOD

[75] Inventor: Bruce W. Friday, Webster, N.Y.

[73] Assignee: Xerox Corporation, Stamford, Conn.

[21] Appl. No.: 628,181

[22] Filed: Nov. 3, 1975

[51] Int. Cl.[2] ..... G03G 15/16

[52] U.S. Cl. ..... 355/3 TR; 355/73

[58] Field of Search ..... 355/3 R, 3 TR, 3 DR, 355/3 BE, 4, 11, 16, 73, 76; 271/197, 196; 226/95; 198/689

[56] References Cited

U.S. PATENT DOCUMENTS

| | | | |
|---|---|---|---|
| 3,633,543 | 1/1972 | Pitasi et al. | 427/24 X |
| 3,832,055 | 8/1974 | Hamaker | 355/3 TR |
| 3,986,773 | 10/1976 | Marx et al. | 355/3 TR |

*Primary Examiner*—Joseph W. Hartary
*Assistant Examiner*—W. J. Brady
*Attorney, Agent, or Firm*—James J. Ralabate; Clarence A. Green; William A. Henry, II

[57] ABSTRACT

A reproduction system in which an image is formed on an imaging surface and transferred at a transfer station to a copy sheet, where the copy sheet is transferred through the transfer station by transport means having a plurality of apertures therein through which a vacuum is applied and includes a means to continuously vary those apertures of the transport means within which the vacuum is applied throughout the transfer zone in order to substantially eliminate adverse effects of vacuum hole printout on the pneumatically constrained copy sheet.

12 Claims, 5 Drawing Figures

TRANSFER APPARATUS AND METHOD

BACKGROUND OF THE INVENTION

This invention relates to transfer apparatus and method and more particularly to a transfer apparatus and method that reduces or substantially eliminates adverse effects of vacuum holes on pneumatically constrained paper transported through a transfer zone.

In reproduction processes, such as in the process of xerography, wherein a latent image is formed on an electrostatic member and then made visible, or developer, with a powderous material, the electrostatic member can be used repeatedly to form additional images in successive cycles if the developed image is transferred from it to another substrate such as a copy sheet during each cycle. When the xerographic process is employed, the electrostatic member can take the form of a photoconductive layer over a conductive backing material. The photoconductive layer is given a uniform electrostatic charge and then exposed to a light image conforming to the information to be reproduced to form a latent electrostatic image on the member. The member is then developed with a finely divided, pigmented, electroscopic resinous powder called toner and the toner image is then transferred to a copy sheet. After transfer is complete, the surface of the electrostatic member can be cleaned and the reproduction process started again, if desired.

The most desirable aspects of a transfer apparatus are high transfer efficiency with no image defects and high reliability, including insensitivity to external machine variables (relative humidity, paper type, etc.) where both are achieved with minimum complexity and cost. Transfer systems in the past that included pneumatically constrained paper transport through the transfer zone had the disadvantage of being unable to achieve all of the above desirable features because of printout of the vacuum holes located within the transport member on the copy resulting from, for example, a distortion of the electrostatic fields. Prior art devices that disclosed the use of a vacuum source in conjunction with a transport conveyor to transport sheets through a transfer zone includes U.S. Pat. No. 3,647,292 and U.S. Pat. No. 3,832,053.

Accordingly, it is an object of this invention to improve transfer so as to eliminate or substantially reduce the adverse effects of vacuum hole printout in pneumatically constrained paper.

It is a further object of this invention to present a continuously contrasting pattern of vacuum holes within the transfer zone to counteract vacuum hole printout.

It is a still further object of this invention to improve transfer regardless of machine variables.

SUMMARY OF THE INVENTION

In a reproduction system having an imaging member carrying a toner image with a means to transfer the toner image from the imaging member to the substrate in a transfer zone and including a transport means having apertures therein to transfer the sheet through the transfer zone in synchronism with the image on the imaging member in addition to means for placing a vacuum on the transport means through the apertures to hold the substrate against the transport means, an improvement is disclosed that comprises a means to continuously vary those apertures of the transport means within which the vacuum is applied throughout the transfer zone whereby the pattern of holes in the transport means do not reproduce on the transferred image.

BRIEF DESCRIPTION OF THE DRAWINGS

For a better understanding of the invention as well as other objects and further features thereof, reference is had to the following detailed description of the invention to be used in conjunction with the accompanying drawings, wherein.

DESCRIPTION OF THE PREFERRED EMBODIMENT

The present invention can be adapted to any reproduction apparatus wherein an electroscopic, pigmented powder used to develop an electrostatic latent image on an electrostatic member is transferred from the member to a copy sheet. For the purpose of this disclosure, however, the invention will be described within the environment of a xerographic reproduction apparatus. An example of such a xerographic reproduction apparatus is shown in U.S. Pat. No. 3,697,050 to Michael R. Stanley. The above cited reference as well as U.S. Pat. No. 3,707,138 to Cartright and U.S. Pat. No. 3,719,165 to Trachienkerg et al show belt imaging surface photoconductors in electrographic copying systems and therefore teach details of various suitable exemplary xerographic structures, materials, and functions to those skilled in the art. Further examples are disclosed in the books *Electrophotography* by R. M. Schaffert, and *Xerography and Related Processes* by John H. Dessauer and Harold E. Clark, both first published in 1965 by Focal Press Limited, London, England. All references cited herein are incorporated in this specification.

Figure 1:
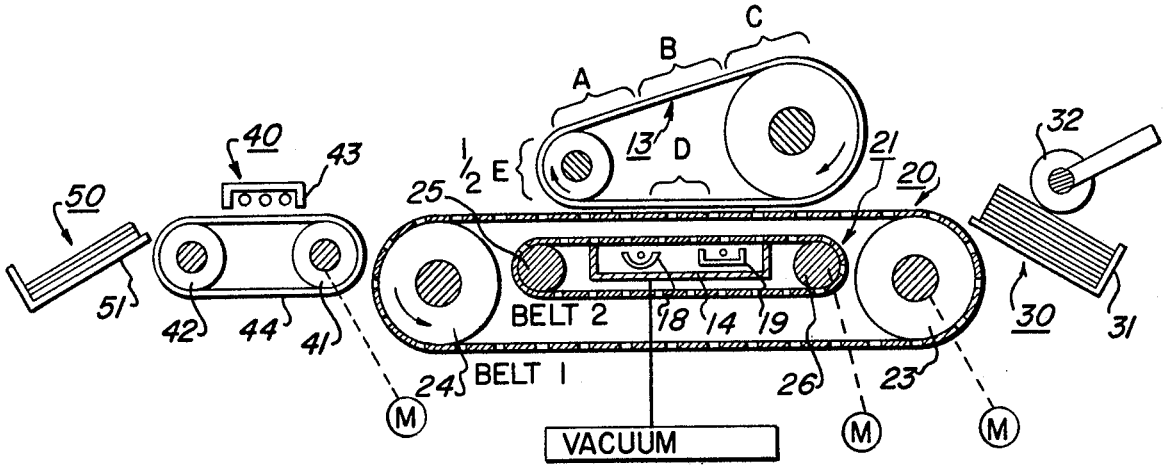
FIG. 1 is a schematic of the invention.

Referring to FIG. 1, there is shown an exemplary continuous xerographic copier having a photosensitive member in the shape of a belt 13 on which a latent electrostatic image of the information to be reproduced is formed. Although a belt 13 is shown as the photosensitive member, it should be understood that a drum could be used instead. The belt is rotatably driven by drum 60 which is driven by any suitable drive means (not shown). The belt has an inner surface layer 12, an electrically conductive material, which, in turn, is covered by layer 11 on its outer surface that is made of a vitreous selenium. The belt has five processing stations located about its periphery which carry out the steps of the xerographic process. These stations include charging station A, exposing station B, developing station C, transfer station D, and cleaning station E.

A latent electrostatic image is formed on the belt by passing its surface through charging station A and exposing station B. The charging station A includes any suitable means for placing a uniform charge on layer 11 such as a corona charging device. Exposing station B can include any suitable device which projects and focuses a light pattern on the belt conforming to the image to be reproduced by the xerographic system. The light image projected onto the charge conductive layer of the belt is synchronized with the movement of the belt and causes selective charge dissipation on elemental areas of layer 11 to form a latent electrostatic image thereon.

After formation of the latent electrostatic image by passing the belt through stations A and B, the belt is passed on to developer station C where a pigmented, resinous, electroscopic powder called toner is deposited on the belt in imagewise configuration in any suitable manner to develop, or make visible, the latent image. Following the development step, the belt carries the toned image through transfer station D where the toner image is transferred from the belt to any suitable support material such as copy sheet 15 which can be made of paper. In addition to paper sheets, a continuous web or any other form of substrate may be used to receive the toner image.

Transfer of the toner image onto the copy sheet is carried out by corona devices 18 and 19. The copy sheet 15 is fed onto the surface of a first belt or conveyor 20 by any suitable device such as feeding device 30 which may include tray 31 to hold a supply of copy sheets and feed roller 32 which feeds the sheets one at a time as needed on to the conveyor. The belt is supported by rollers 23 and 24 and driven in a counterclockwise direction by motor M at velocity $V_1$. The belt 20 also has a plurality or multiplicity of holes that can have any shape desired such as diagonal slits, circular, etc., through which a vacuum is imposed on sheet 15 by vacuum chamber 14.

A sheet is fed onto the conveyor by feeding device 30 and is carried through transfer station D adjacent photo-sensitive belt 13. As it passes through the transfer station, a toner image on the belt surface adjacent the copy sheet is transferred to the copy sheet due to the electrical field created between the copy sheet and the belt 13 by the bias on corona devices 18 and 19.

After the toner image has been transferred to the copy sheet and the copy sheet has passed through the transfer zone or station, the copy sheet passes onto belt 44 supported by rollers 41 and 42 and driven by motor M at fixing station 40. Any suitable fixing device 43 makes the toner image permanent on the copy sheet. The copy sheet then moves off the belt 44 and falls into collection device 50 where it is stored in tray 51.

The final station shown in the drawing is cleaning station E which can include any suitable cleaning device such as fur brush which contacts the photoconductive surface of the belt 13. The cleaning station is utilized to remove any residue toner particles from the photosensitive surface after transfer occurs and before another cycle is begun. It is intended that the various moving elements mentioned above be driven by any suitable means to allow the copier to function as described: for instance, a single motor such as M can drive belt 13 and the other moving elements in the copier as well as the belts 20, 21, and 40.

One of the possible copy quality defects associated with a pneumatically constrained paper transport is printout of the vacuum holes on the copy paper resulting from among other things a distortion of the electrostatic fields.

The problem to which the present application is specifically directed is that where an apertured vacuum transport belt carries the copy sheet through the transfer station D, a corona charge placed on the back of the belt can cause uneven transfer fields from the vacuum holes in the belt if the belt is insulative (dielectric) unless the belt is very thin, yet the use of such a very thin belt has a number of mechanical and material disadvantages. Corona charges can pass up through the holes, and the dielectric constant of the air in the apertures will normally be substantially different from that of the belt material. The uneven transfer fields can cause visible (print-out) defects in the copy. The solution disclosed herein is to include within the transfer zone a means to continuously vary those apertures of the transport means within which the vacuum is applied throughout the transfer zone in order to substantially eliminate adverse effects of vacuum hole print-out on the pneumatically constrained copy sheet.

The holes in the apertured belt are desirably large enough to provide sufficiently unobstructed air flow to hold porous paper against the belt and so as to not tend to become clogged with toner or paper lint particles; however, with dielectric belts an increase in hole size would increase the tendency of the dielectric belt to cause transfer printout defects on the copy, particularly if the holes are larger than approximately 4 mils (0.1 milimeter).

Hole print-out is a function of the difference in transfer efficiency between the hole and no hole belt areas. This efficiency difference is more critical at low transfer field levels (less than 20 volts/micron). With a dielectric belt, the voltage drop across the belt in any region near the transfer nip is a function of the dielectric constant and the thickness of the belt and not of its resistivity. Thus, the dielectric belt thickness reduces the effective transfer field strength. As noted, the dielectric belt can cause uneven transfer fields in the vacuum hole areas, and this can cause visible copy defects unless the belt is less than a few mils in thickness.

Figure 2:
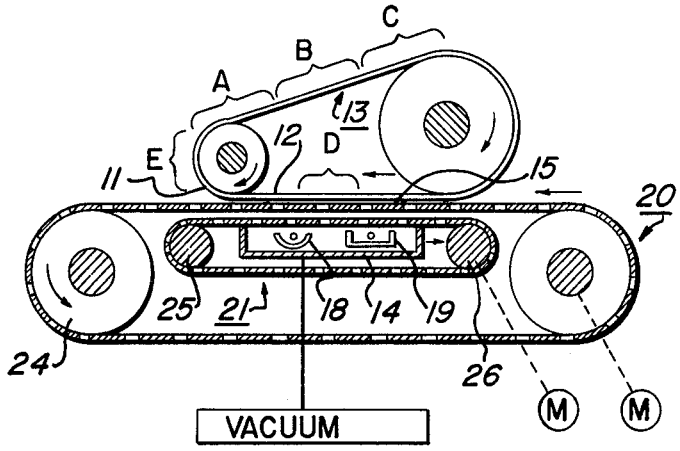
FIG. 2 is a detailed view of a first embodiment of the invention.

It is within the confines of the transfer station D that the present invention is utilized. FIG. 2 shows a more detailed view of this invention in the form of a second belt 21 located within the first belt 20 and positioned closely adjacent thereto. Second belt 21 has a plurality of apertures therein that can be diagonal, circular, rectangular or any other shape in design and is supported by rollers 25 and 26, and driven in a clockwise direction by motor M at the same or different velocity $V_z$ than belt 20. If one desired to drive both belts 20 and 21 in the same direction $V_z$ would be different from $V_l$. Located within belt 21 are corona transfer devices 18 and 19 for generating a transfer field that attracts the toned image from the imaged belt to the copy sheet. It should be understood that other transfer methods could be used rather than electrical corona devices, such as biased roll transfer. The disadvantages of earlier transfer devices of allowing vacuum hold print-out from pneumatically constrained paper transporting means, such as dielectric belts, due to, for example, distortion of the electrostatic fields is alleviated or substantially reduced by using belt 21 as an auxiliary member to continuously vary the apertures of the transport means 20 by propelling belt 21 in an opposite or different direction from the transport means whereby a vacuum is applied to the sheet on the transport means only through those apertures in the transport means which overlap with the apertures in the auxiliary member during the time of such overlap. In essence, the means supported within and closely adjacent the transport means that has an array of apertures therein is a transfer field smoothing means that operates so as to present a contrasting pattern to the apertures of the transport means and thereby allows the image that is to be transferred to the copy sheet to be transferred without image defects. The transfer field smoothing means permits transfer without transfer field distortion with a more uniform field strength being presented to the copy sheet that results in substantial elimination of vacuum hole printout on the copy sheet. Even if the defects were to still be present with the use of this invention they would essentially be distributed throughout the entire body of the copy with no noticeable severity. This distribution comes as a result of the endless conveyor belt 20 moving in one direction to transport the copy sheet and endless belt 21 moving in a different direction while being positioned closely adjacent the inner surface of paper transport 21. This relative movement between members 20 and 21 present a smooth transfer field from corona devices 18 and 19 to copy sheet 15, and therefore, gives out a printout copy sheet with desirable copy quality defects. The belts 20 and 21 could be moved at substantially the same velocity, but it is preferred to move them at different velocities.

Figure 3:
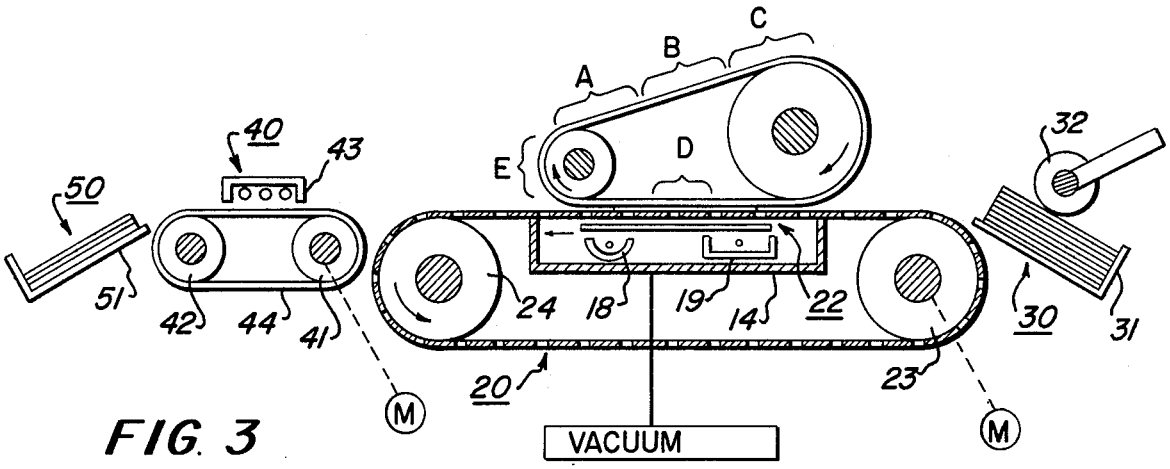
FIG. 3 is a second embodiment of the invention.

FIG. 3 shows another embodiment of this invention in that the means to continuously vary the apertures of belt 20 by presenting a contrasting pattern to the belt is shown as a fixed plate 22. The fixed plate 22 is located within transport member 20 and positioned closely adjacent thereto and by the pattern of holes in the fixed plate present an array of apertures to the underside of belt 20 different from the apertures in belt 20. Since the transport member moves the copy sheet over the apertured stationary plate, the area of the apertures in belt 20 available to action by vacuum means 14 is continuously varied with a resultant uniform transfer field strength being presented to copy sheet 15 with an image being transferred to copy sheet 15 from toned image surface 11 substantially devoid of vacuum hole printout on the copy sheet.

Figure 4:
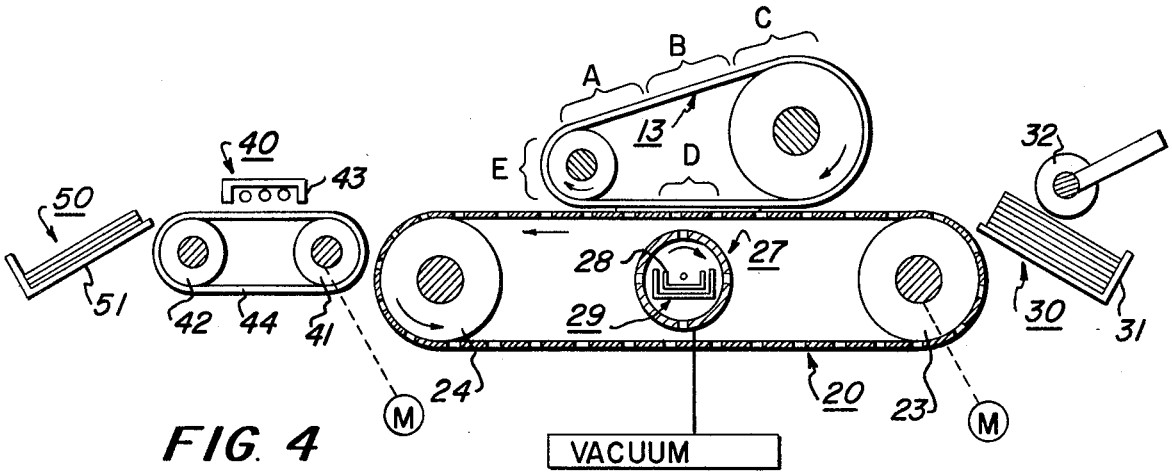
FIG. 4 is a third embodiment of the invention.

Another embodiment of this invention is shown in FIG. 4. In this apparatus the means to present a continuously varying pattern of holes to the copy sheet 15 is in the form of a circular apertured transfer field smoothing member 27 with a transfer field generating means 28 and a vacuum source 29 located therein. The apertures in member 27 can be of any shape desired, for example, circular, diamond, etc. The sheets 15 are fed at a certain velocity toward the transfer zone by apertured belt 20 in a first direction held thereon by vacuum means 29. Circular member 27 is rotated by a motor (not shown) with the apertures in member 27 being different in shape from the apertures in belt 20. Transport means 20 could be circular with circular member 27 therein if one desired, but preferably transport means 20 is a belt. As the copy sheet 15 passes through transfer station D transfer field generating means, which in this example is a corona device 28, but any transfer field generating means could be used, generates a smooth transfer field of uniform strength through the field smoothing member 27 and belt 20 with copy sheet 15 being printed devoid of transfer field distortion as a result. This smooth transfer field is applied to the sheet 15 because of the contrasting patterns of apertures in transport means 20 and member 27 and the relative movements between the two to continually change the workable diameter of the apertures of transport 20 to the suction of vacuum 29 and corona device 28.

Figure 5:
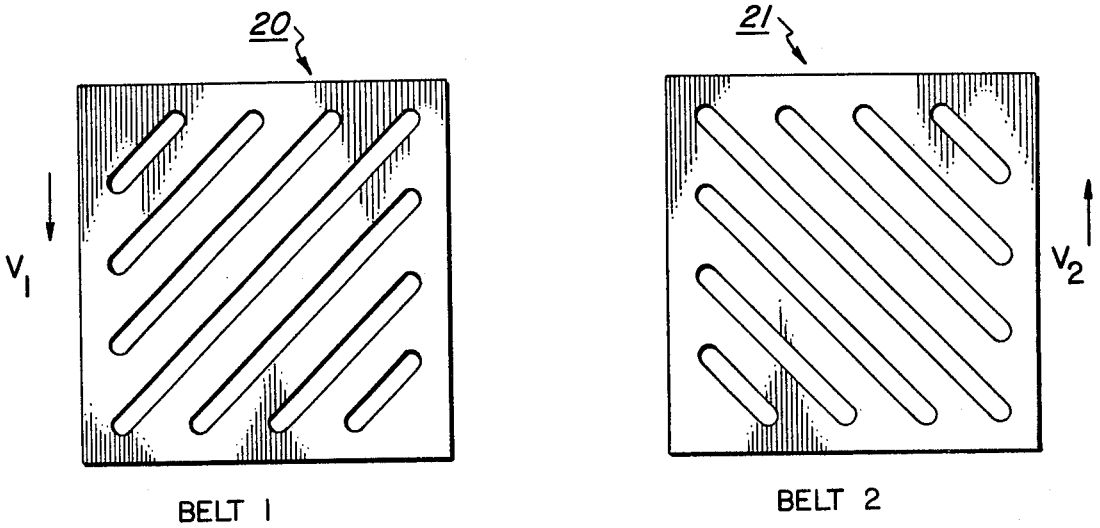
FIG. 5 is an exploded top view of belts 20 and 21 in FIG. 1 showing the apertures therein.

In FIG. 5 an exploded top view of belts 20 and 21 shows the shape of the apertures in the belts in relation to one another as well as within each belt. These shapes can vary according to the desires of the user, however, the shape that is disclosed in FIG. 5 for the two belts 20 and 21 is oppositely diagonal. In use the diagonal slits of belt 20 that are slanted from the upper right side to the lower left side thereof as viewed in FIG. 5 is presented in the transfer zone with a contrasting pattern of slits in belt 21 which has oppositely diagonal slits therein that are slanted from the upper left side to the lower right side thereof. This contrasting pattern of oppositely diagonal slits in the two belts allows a vacuum to reach the paper that is conveyed through the transfer zone only during overlap of the slits.

In addition to the apparatus outlined above, many other modifications and/or additions to this invention will be readily apparent to those skilled in the art upon reading this disclosure, and these are intended to be encompassed within the invention disclosed and claimed herein.

What is claimed is:

1. In a reproduction system having an image member carrying a toner image, means to transfer said toner image from the imaging member to a substrate in a transfer zone, transport means having apertures therein to transport said substrate through said transfer zone in synchronism with the image on the imaging member and means to place a vacuum on the transport means through the apertures to hold said substrate against the transport means, the improvement comprising: means located substantially at the point of transfer for continuously varying those apertures of the transport means within which the vacuum is applied throughout the transfer zone, said means for varying the apertures of the transport means through which vacuum is applied being adapted to change the effect area of the apertures exposed to said means to place a vacuum whereby the pattern of holes in the transport means does not reproduce on the transferred image.

2. In a reproduction system having an imaging member carrying a toner image, means to transfer said toner image from the imaging member to a substrate in a transfer zone, transport means having apertures therein to transport said substrate through said transfer zone in synchronism with the image on the imaging member and means to place a vacuum on the transport means through the apertures to hold said substrate against the transport means, the improvement comprising:

an auxiliary member having apertures therein and located in the transfer zone between the transport means and the vacuum means, and means to move said auxiliary member differently from the transport means whereby vacuum is applied to the substrate on the transport means only through those apertures in the transport means that overlap with the apertures in the auxiliary member during the time of such overlap.

3. In an automatic reproduction device of the type having a rotatable imaging plate arranged to move at a predetermined rate through a path of travel, means to form a charged toner image of an original upon said plate, transfer field means to transfer the image to a sheet of final support material within a transfer zone, the improvement comprising:

first and second movable belts with an array of apertures therein arranged to move in opposite directions over an endless path of travel through said transfer zone in order to vary the effective area of the apertures in said first and second movable belts presented to a vacuum means said second movable belt being located and supported inside said first movable belt and that portion of said first belt moving through the transfer zone being supported adjacent to said imaging plate within the transfer zone, and vacuum means to secure a sheet of final support material to said first belt wherein the sheet is transported through the transfer zone in registered synchronous moving contact with the toner image on said imaging plate, whereby a resultant image is transferred to the sheet without distortion of the transfer fields.

4. The improvement of claim 3, wherein the apertures in said first and second belts are arranged in an oppositely diagonal pattern.

5. In an electrostatographic copying system in which an image is formed on an imaging surface and transferred at a transfer station to a copy sheet by transfer means, the improvement comprising:

copy sheet transport means having a multiplicity of apertures formed therein, support means for supporting said transport means adjacent said transfer station, means supported within and closely adjacent said transport means having an array of apertures therein that effectively varies the area of the apertures in said transport means that is presented to a vacuum means, means for moving at least one of said transport means and said means supported within said transport means relative to one another past said transfer station, vacuum means positioned within said means located within said transport means for holding sheets on said transport means as the sheets pass the transfer station, whereby the image is transferred to the copy sheets without transfer field distortion.

6. The improvement of claim 5, wherein said means supported within said transport means is a fixed plate.

7. The improvement in accordance with claim 5, wherein said apertures in said transport means and means within said transport means are a series of diagonal slits.

8. The improvement of claim 5, wherein said apertures of said means supported within said transport means are circular in shape.

9. The improvement of claim 5, wherein said means supported within said transport means is a rotating apertured cylinder.

10. In a reproduction system having an imaging member carrying a toner image, means for forming a transfer field to transfer said toner image from the imaging member to a substrate in a transfer zone, transport means having apertures therein to transfer said sheet through said transfer zone in synchronism with the image on the imaging member and means to place a vacuum on the transport means through the apertures to hold said substrate against the transport means, the improvement comprising:

fixed transfer field smoothing means supported within and closely adjacent said transport means having a multiplicity of apertures therein that present a contrasting pattern to the apertures in the transport means which effectively varies the area of the apertures in the transport means that is presented to said vacuum means whereby a more uniform field strength is presented to the substrate.

11. A method of reducing the effects of vacuum holes on a substrate in the transfer zone of a reproduction machine comprising the steps of:

a. moving the substrate through the transfer zone on an apertured support, b. applying a vacuum from a source through said apertured support to hold the substrate thereon, c. locating an apertured member between said apertured support and the vacuum source with said apertured member being positioned closely adjacent said apertured support member and moving said apertured member differently relative to said apertured support member so as to present a continuously varying pattern of apertures to the substrate during the passage of the substrate through the transfer zone and thereby allow an image to be printed on the substrate substantially devoid of vacuum hole printout

12. The method of claim 11, including the step of:

moving said apertured member in a direction different from said apertured support movement while the substrate is being transported through the transfer zone.

* * * * *